United States Patent [19]

Marulic et al.

[11] 4,068,410

[45] Jan. 17, 1978

[54] RAILWAY CAR DOOR LOCKING MECHANISM

[75] Inventors: Walter J. Marulic, Gary, Ind.; Ray L. Ferris, Thornton, Ill.

[73] Assignee: Pullman Incorporated, Chicago, Ill.

[21] Appl. No.: 662,494

[22] Filed: Mar. 1, 1976

[51] Int. Cl.[2] ..... E06B 3/42

[52] U.S. Cl. ..... 49/370; 49/449; 292/186

[58] Field of Search ..... 49/449, 450, 220, 344, 49/395, 366, 367, 369, 370, 220; 292/186, 167, 158, 139

[56] References Cited

U.S. PATENT DOCUMENTS

| | | | |
|---|---|---|---|
| 2,270,559 | 1/1942 | Rolph et al. | 292/167 |
| 3,039,154 | 6/1962 | Beauchamp | 49/220 X |
| 3,179,984 | 4/1965 | Bailey | 49/220 |

*Primary Examiner*—Kenneth Downey
*Attorney, Agent, or Firm*—John A. Doninger

[57] ABSTRACT

A pair of laterally movable sliding doors include one door provided with a vertical hollow side frame member within which is housed a reciprocating locking bar adapted to engage a keeper mounted on the car below the door. The locking bar is reciprocated by a bell crank handle and lever arrangement which is pivotally connected to one end of a rockable link or arm supported on the door, the link including an end projecting into the side frame member for pivotal connection to the upper end of the locking bar.

5 Claims, 6 Drawing Figures

FIG. 1
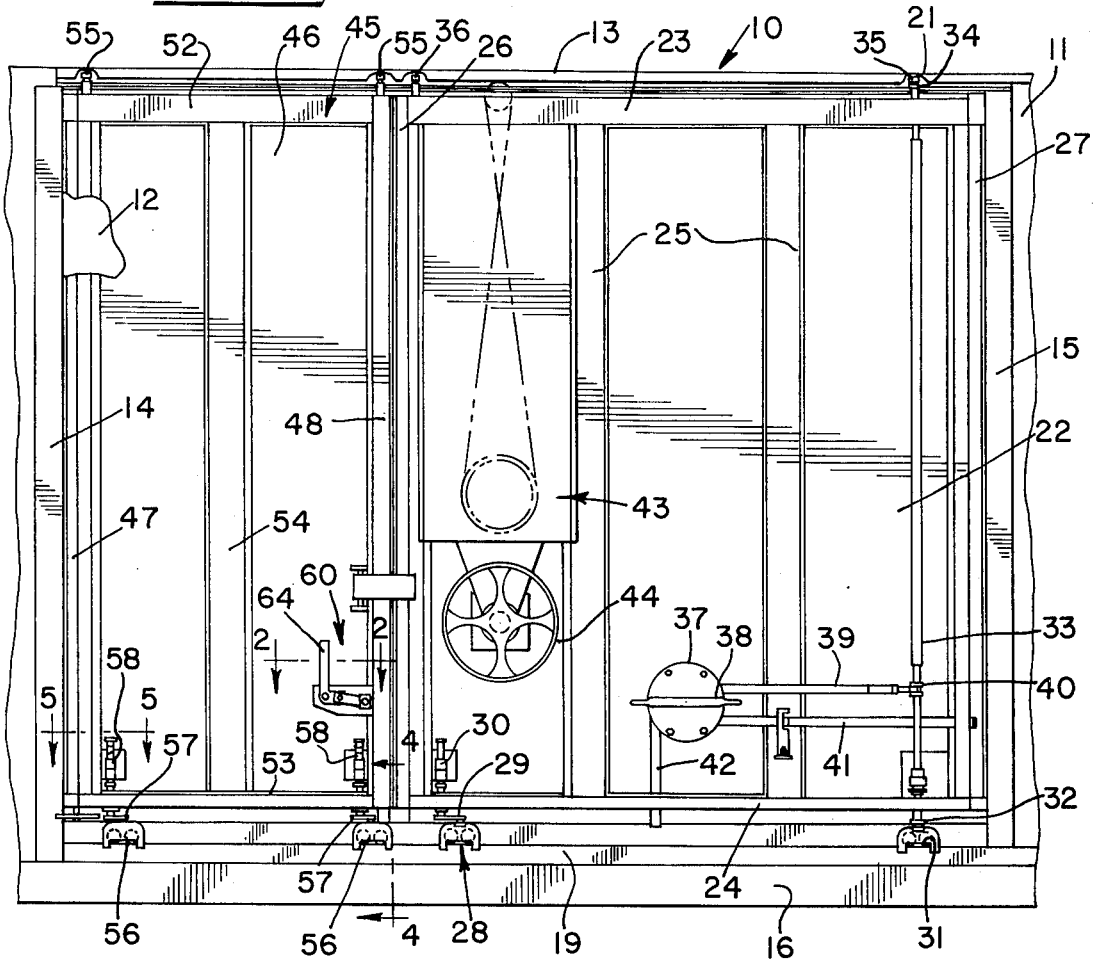
FIG. 2
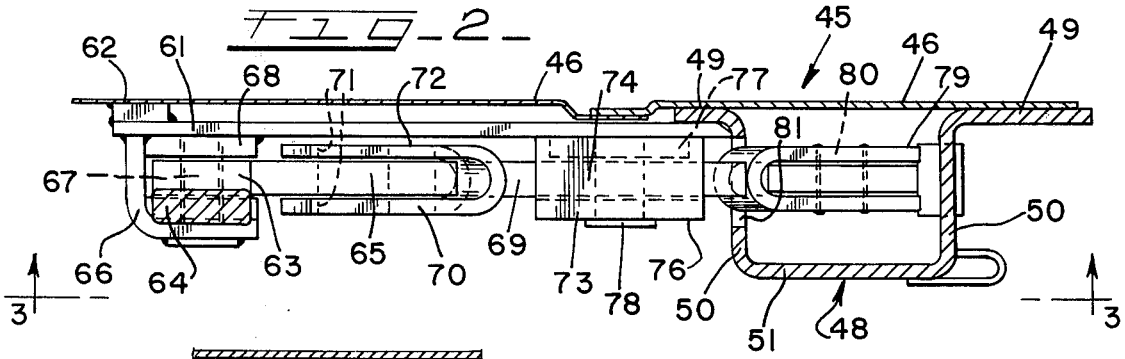
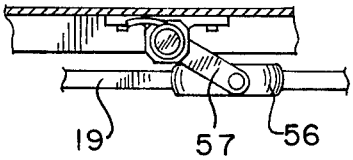
FIG. 5

60
61
63
64
65
66
67
69
70
71
72
73
74
75
76
77
78
79
80
81
82
83
84
85
86
87
88
89
90
91
92
46
48
49
50
51
45
12
16
17
18
19
19'
56
57

RAILWAY CAR DOOR LOCKING MECHANISM

BACKGROUND OF THE INVENTION

1. Field of the Invention

The present invention relates to a double door arrangement of the plug and sliding type for enclosing an exceptionally large door opening in the side of a railway box car.

2. Description of the Prior Art

The prior art pertaining to box car doors includes cars having enlarged door openings which are usually covered by a sliding door of a relatively large size also having a plug type of mechanism which upon operation thereof withdraws locking bolts from locked relation relative to a door frame and thereupon moves the door upwardly of the door opening whereupon it may be moved to one side of the opening. A somewhat smaller auxiliary door also is provided which also can be moved in sliding relation to one side of the door opening adjacent to the larger door thus, exposing the entire large door opening. Such auxiliary doors also are provided with locking arrangements which secure the auxiliary door in locked position. Such a door is shown in U.S. Pat. No. 3,179,984 including also for operating mechanisms for locking both doors in position. The present invention is particularly concerned with respect to a novel and more effective door locking arrangement for the auxiliary or smaller door of the combination.

SUMMARY OF THE INVENTION

In the present invention an enlarged door opening in the side of a railway car includes a large first door and a smaller second or auxiliary door, each of the doors being capable of being moved in sliding relation to one side of the door opening to completely expose the same. The larger door is provided with a door opening mechanism of a rotatable type which withdraws locking bars to an open position and thereupon rotates a pipe and crank arm arrangement mounted on suitable rollers for moving the larger door outwardly so that it may then readily be moved out of the way to one side of the door opening. This type of door and a door sliding mechanism is well shown in U.S. Pat. No. 3,816,965, patented June 18, 1974.

The second or auxiliary door also is supported on roller mechanisms on a track similar to the first door so that it may be slidingly moved to one side and out of the door opening. The second door also is provided with a novel arrangement for locking and unlocking the door relative to the door frame of the opening. This includes a hollow frame member forming one side of the auxiliary door, the same including a vertically reciprocable locking bar which is adapted to be vertically moved into and out of locking engagement relative to a part of the door frame. The locking bar is moved by means of a bell crank type of handle lever and arm arrangement which is pivotally connected to a rockable arm or link suitably mounted on the side of the door. The movable link has one end extending into the hollow frame member and is pivotally connected through a slot to the locking bar so that upon pivotal movement of the handle and lever arrangement the locking bar is vertically raised and lowered as desired from lock positions to unlock positions and vice versa.

BRIEF DESCRIPTION OF THE DRAWINGS

FIG. 1 is a side elevational view of a box car having an enlarged opening showing an enlarged plug type sliding door and a second auxiliary door positioned to close the opening;

FIG. 2 is a cross sectional view taken substantially along the line 2—2 of FIG. 1;

FIG. 5 is a plan view of the roller and swivel assemblies taken along the line 5—5 of FIG. 1.

DESCRIPTION OF THE PREFERRED EMBODIMENT

Figures 3, 4, 6:
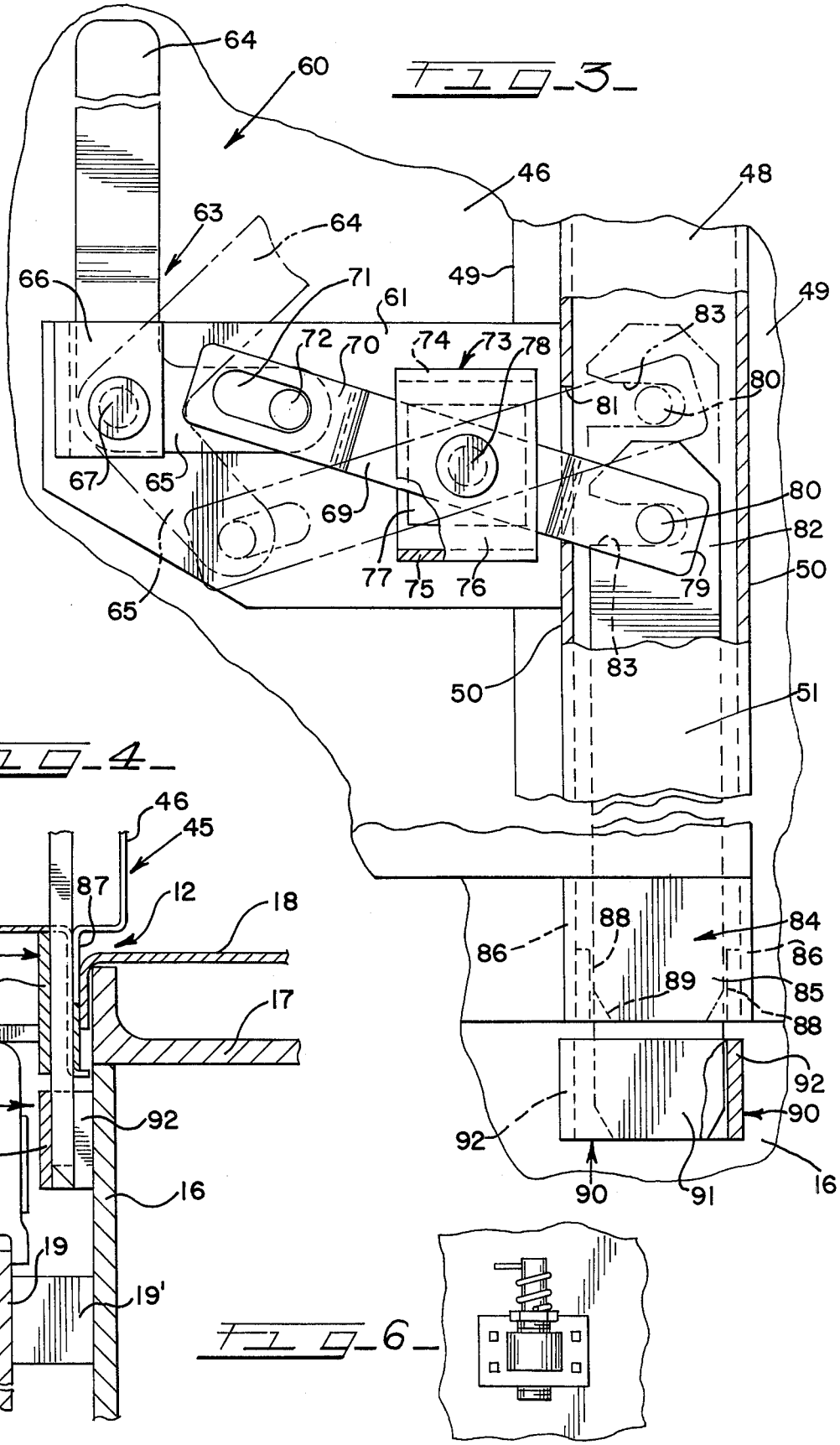
FIG. 3 is a side elevational detailed view taken along the line 3—3 of FIG. 2.
FIG. 4 is a cross sectional view taken substantially along the line 4—4 of FIG. 1.
FIG. 6 is an enlarged side elevation view of the swivel shown in FIG. 1.

A railway box car of conventional type is generally designated by the reference character 10 and includes side walls 11 provided with door openings 12 only one of which is shown. The door opening 12 is defined by an upper horizontally extending header member 13 connected to the upper ends of vertical side frame members 14 and 15, respectively. The side wall below the door opening 12 also includes a lower wall portion 16 supporting a threshold member 17 in turn supporting a floor 18 which may extend the length of the interior of the box car. A horizontal track 19 is connected to the lower wall portion 16 by means of brackets 19' as best shown in FIG. 4.

A large first door of the sliding and plug type is generally designated by the reference character 21 and includes vertically extending door sheathing 22 suitably connected to an upper frame member 23 and a lower frame member 24. The sheathing is further supported by means of upright beams 25 also connected to the upper frame member 23 and lower frame member 24. The sheathing is further connected to side frame members 26 and 27 in turn respectively connected to the frame members 23 and 24. The door 21 is supported at one side by roller and swivel assembly provided with a crank arm 29 in turn suitably connected to a swivel 30 in turn supported on the lower end of the door 21 in conventional fashion. The other side of the door also is supported on a roller assembly 31 having a crank arm 32 connected to a pipe 33 extending vertically the length of the door. The roller and swivel assemblies 28 and roller assembly 31 are suitably supported on the track 19 permitting the door 21 to be moved laterally to one side of the door opening 12. The upper end of the pipe 33 is also suitably connected to a crank arm 34 in turn connected to a guide roller 35 suitably supported in guiding relation by the upper header member 13. A similar guide roller 36 supports the other end of the door 21 on the upper header member 13.

A door actuating mechanism 37 includes a handle member 38 which upon rotation provides for reciprocation of linkage 39 connected by means of a bracket 40 to the pipe 33. The mechanism 37 also is adapted to actuate horizontal and vertical locking bolts 41 and 42, respectively, which are adapted to engage portions of the door frame in locking and unlocking relation. The arrangement and operation of the door actuating mechanism 37 is more specifically described in U.S. Pat. No. 3,816,965 patented June 18, 1974. This patent also specifically discloses the construction and operation of a door moving mechanism which in the present application is designated at 43. The mechanism 43 may be actuated by a hand wheel 44 which is adapted to power suitable force multiplying means whereby the door 21 may be easily moved to one side of the door opening.

An auxiliary or second door of smaller width is designated at 45 and includes door sheathing 46 suitably connected to vertically extending transversely spaced side frame members 47 and 48. The side frame member 48 is of channel shaped or hat-shaped construction including flanges 49 connected to side walls 50, said side walls in turn being connected by a front wall or web 51. This thus provides for a hollow construction of the frame member 48, both of said frame members being connected to upper frame members 52 and lower frame members 53. The door sheathing further is supported by means of a vertical support beam 54 connected to the upper and lower frame members 52 and 53.

The upper ends of the door 45 are guided by means of roller guides 55 in the upper header member 13 similar to the roller guides 36 afore-mentioned. The lower ends of the door 45 are supported on roller and swivel assemblies 56 each of which includes a crank arm 57 suitably connected to a swivel 58 supported on the door the roller assemblies 56 in turn being supported on the track 19 in supporting and rolling relation.

A locking mechanism 60 is provided for the second door 45 and includes a bracket 61, as best shown in FIG. 2, which is supported at one end by means of a spacer 62 on the sheathing 46. The other end of the bracket 61 is suitably connected to one of the flanges 49 of the hat shaped frame member 48. A bell crank lever 63 includes a handle portion 64 connected to a laterally extending arm 65. An L-shaped bracket 66 is suitably connected to the bracket 61 and supports the bell crank lever 63 for pivotal movement by means of a pivot pin 67 which is supported by means of a pivot block or plate 68 in turn connected to the bracket 61. An actuating rocking bar or link as designated at 69 and as best shown in FIGS. 2 and 3 includes a U-shaped clevis 70 at one end provided with slots 71. An actuating pivot stud 72 connected to one end of the arm 65 engages the slots 71 for rocking the bar 69. The rocking action is supported by means of a bracket 73 which includes flanges 74 and 75 connected to a vertical plate 76. The flanges 74 and 75 are suitably connected to the bracket 61. A pivot plate or block 77 supports a pivot stud 78 on the bracket 61. The said stud 78 is also supported on the wall 76 of the bracket 73.

The other end of the arm 69 also has connected thereto a U-shaped clevis 79 which supports a pivot stud 80. The clevis 79 projects through an opening 81 provided in one of the side walls 50 as best shown in FIGS. 2 and 3. A vertically reciprocable locking bar 82 as best shown in FIG. 3 is positioned within the side frame member 48 and includes a slot 83 at its upper ends which is engaged in actuating relation by means of the pivot stud 80. As best shown in FIG. 4, a guide member 84 includes a front plate 85 and inwardly extending flanges or side walls 86 which are suitably connected to an extension 87 of the sheathing 46. The guide member 84 also is provided with inner guide plates 88 which guide the lowered tapered end 89 of the bar 82. A keeper designated at 90 is suitably supported on the lower wall portions 16 and includes a front wall or plate member 91 and inwardly extending flanges 92 suitably connected to the said wall portion 16.

OPERATION

FIG. 1 discloses both of the door 21 and 45 in the closed position relative to the door opening 12. Supposing now that limited access to the door opening 12 is desired, the door 21 is moved laterally to one side of the door opening by means of the operating mechanism 37. Upon initial rotation of the handle member 38 the locking bars 41 and 42 are moved out of locking engagement with respect to the door frame an upon further turning movement the linkage 39 rotates the pipe 33 thereupon moving the edge of the door outwardly so that it now can be moved on the track 19 to one side of the door opening. Further sliding movement is assisted by rotation of the hand wheel 44 which provides an assist, by force multiplying means, to the operator in sliding the door to one side of the opening. This is clearly described in the afore-mentioned patent.

In order to move the auxiliary or second door 45 to an open position the operator actuates the handle and lever arrangement 64 of the locking mechanism 60. By rotating the handle 64, as shown in FIG. 3 in a clockwise direction as shown in the broken line position of FIG. 3 the actuating bar or link 69 is pivoted on the pivot 78 and the one end of the bar 69 containing the clevis 70 is moved downwardly whereupon the clevis 79 is moved upwardly which in turn provides for the pin 80 exerting an upward thrust on the locking bar 82 thereupon disengaging the lower tapered end 89 of the bar relative to the keeper 90. The door 45 now may be moved also to one side of the door opening 12 and the entire door opening is now open for access into the interior of the railway car. When the doors 21 and 45 are to be returned to their locked and closed position the reverse operation takes place.

It is apparent from the foregoing description that the locking mechanism 60 is particularly effective in that the rocking link or bar 69 provides for a leverage or force multiplying condition which easily moves the locking bar 82 between the open and closed positions with a limited amount of power necessary on the part of the operator in shifting the handle lever 63. This is particularly desirable in door arrangements wherein most of the doors of the prior art include mechanisms which are very difficult to operate because of the many varied conditions such as freezing, snow, etc. to which these mechanisms are subjected thereby making them difficult to open and close when desired.

The foregoing description and drawings merely explain and illustrate the invention and the invention is not limited thereto, except insofar as the appendant claims are so limited, as those skilled in the art who have the disclosure before them will be able to make modifications and variations therein without departing from the scope of the invention.

What is claimed is:

1. In a railway car having a side wall provided with a door opening, first and second doors slidingly supported on said car and movable from a closed position over said opening to one side thereof to an open position, door actuating mechanism on said first door including reciprocating bolt means for locking said first door in said closed position, said second door including a vertically extending hollow side frame member at one edge thereof positioned in contiguous relation to said first door in the closed position thereof, the improvement comprising:

locking means for said second door including;

a locking bar supported within said hollow side frame member for vertical reciprocation;

a keeper supported on said car below said opening adapted to be engaged by said locking bar;

means for reciprocating said locking bar including a bell crank lever pivotally mounted on said second door, and having a vertical handle portion and a leg extending generally horizontally in the locking position of said locking means;

an actuating link pivotally connected to said second door and to said bell crank lever and to said locking bar and in the locking position of said locking means extending lengthwise diagonally downwardly from one end at said bell crank leg to its other end connection with said locking bar, said one end of said actuating link including a slot and said pivotal connection of said leg to said link comprising a first pivot stud extending through said slot, said stud being located in the locking position of said locking means at one end of the slot; and said link having both ends bifurcated and respectively embracing said upper end of the locking bar and said leg for holding said link in operative relation to said leg and bar.

2. The invention in accordance with claim 1, and the upper end of said locking bar including a generally horizontal slot open through one side of the bar adjacent to said link; and said pivotal connection of the link to the bar comprising a third pivot stud supported on the other end of said actuating link engaging said bar in said slot in sliding relation to the bar during rocking movement of said link for lifting and lowering said locking bar; and said hollow frame member having opposing walls confining said bar against substantial lateral movement with respect to said link for maintaining the third pivot stud in engagement with the bar within said slot.

3. The invention in accordance with claim 1, said side frame member having walls, one of said side frame member walls having an opening therein admitting said one end of the link therethrough.

4. The invention according to claim 2, including a guide sleeve supported on said side frame member for slidingly receiving the lower end of said locking bar, and for guiding the same into locking engagement with said keeper and for holding the bar upright in operative relation to said third pivot stud to prevent binding.

5. In a railway car having a side wall provided with a door opening, door means movably supported on the car and movable from a closed position over said opening to one side thereof to open position, a vertically extending hollow frame member on said door means, locking means for said door means including:

a locking bar supported within said hollow frame member for vertical movement upwardly to unlocked position and downwardly to locked position;

a keeper supported on the car below said opening adapted to be engaged by said locking bar during downward movement thereof;

means for moving said locking bar comprising a bell crank lever pivotally mounted on said door, means for pivotal movement generally parallel to said door means, and having a vertical handle and a leg extending generally horizontally in the locking position of said locking means;

an actuating link pivotally connected to said door means intermediate its ends and at one end to said leg of said lever and at the other end to said locking bar;

said link extending lengthwise diagonally downwardly from one end at said lever leg to its other end connection with said locking bar;

said one end of said actuating link including a slot and said pivotal connection between said one end of the link and said leg comprising a first pivot stud extending through said slot, said first stud being located in the locking position of said locking means at one end of said slot, said link being bifurcated at both ends and embracing said leg at one end and said bar at the other end;

said frame member having a slot therein through which said link extends to said bar; and said pivotal connection between the bar and said link comprising a second pivot stud on the link and a generally horizontal slot in the bar receiving said second pivot stud.

* * * * *